US008794741B2

(12) United States Patent
Danzuka et al.

(10) Patent No.: US 8,794,741 B2
(45) Date of Patent: Aug. 5, 2014

(54) INKJET RECORDING APPARATUS AND METHOD FOR CONTROLLING THE SAME

(71) Applicant: Canon Kabushiki Kaisha, Tokyo (JP)

(72) Inventors: Toshimitsu Danzuka, Tokyo (JP); Masaya Uetsuki, Yokohama (JP); Kazuo Suzuki, Yokohama (JP); Masataka Kato, Yokohama (JP); Tsuyoshi Ibe, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/830,532

(22) Filed: Mar. 14, 2013

(65) Prior Publication Data

US 2013/0257978 A1 Oct. 3, 2013

(30) Foreign Application Priority Data

Mar. 30, 2012 (JP) ..... 2012-080097
Feb. 15, 2013 (JP) ..... 2013-027687

(51) Int. Cl.
*B41J 2/165* (2006.01)

(52) U.S. Cl.
USPC ..... 347/33

(58) Field of Classification Search
USPC ..... 347/20, 22, 33
See application file for complete search history.

(56) References Cited

U.S. PATENT DOCUMENTS 7,766,450 B2 * 8/2010 Nishizaki et al. ..... 347/33
7,891,762 B2 * 2/2011 Nakano et al. ..... 347/33

FOREIGN PATENT DOCUMENTS

JP 4072087 B 11/1992

* cited by examiner

*Primary Examiner* — Lamson Nguyen
(74) *Attorney, Agent, or Firm* — Canon USA, Inc., IP Divison

(57) ABSTRACT

An inkjet recording apparatus includes a recording head, a carriage, a wiping unit, and a controller. The recording head has a discharge port face with a plurality of discharge ports to discharge ink. The carriage has the recording head mounted thereon and performs reciprocal scanning. The wiping unit includes a sheet-shaped wiping member to wipe the discharge port face and a conveying unit to convey the wiping member. The controller controls an amount of conveyance of the wiping member by the conveying unit. The controller performs control so that the conveyance amount in a first case, where a time elapsed since a last conveyance operation of the wiping member is greater than or equal to a certain time, becomes greater than the conveyance amount in a second case, where the time elapsed since the last conveyance operation of the wiping member is less than the certain time.

15 Claims, 7 Drawing Sheets

INKJET RECORDING APPARATUS AND METHOD FOR CONTROLLING THE SAME

BACKGROUND OF THE INVENTION

1. Field of the Invention

The present invention relates to an inkjet recording apparatus and a method for controlling the same.

2. Description of the Related Art

Hitherto, inkjet recording technology has been widely researched and developed for its advantages such as that a printer can be manufactured at a relatively low cost. Inkjet recording apparatuses are widely used by general public as consumer devices such as printers and multifunction devices.

In an inkjet recording apparatus, a recording head with ink discharge ports discharges ink to a medium to be recorded. With this ink discharge, ink may be attached to an ink discharge port face where the ink discharge ports are formed. When ink attached to the ink discharge face increases in its amount and contacts the ink discharge ports, troubles such that ink is not discharged (so-called a "discharging failure"), or the discharge direction of ink becomes deviated (so-called a "position error") occur. Therefore, many inkjet recording apparatuses have wiping units for wiping the ink discharge port face.

Such wiping units include one that uses a blade made of an elastic member (so-called "wiper") and one that uses a member such as a porous body impregnated with liquid (hereinafter may also be referred to as a "sheet-shaped wiping unit"). In particular, a sheet-shaped wiping unit is preferably used in an inkjet recording apparatus in which residues of ink attached to the ink discharge port face are firmly attached to the ink discharge port face.

In order that a sheet-shaped wiping unit has an excellent wiping result, it is necessary to wipe an ink discharge port face by using an unused portion of the liquid-impregnated member, which has not previously wiped the ink discharge port face. Therefore, most wiping units are formed to have thin and long sheet shapes, and two ends are rolled around core materials. A conveyance mechanism for conveying a sheet member impregnated with liquid is provided. With this conveyance mechanism, one or both of the core materials, or, in addition to these core materials, an additionally provided conveyance roller are rotated by using a driving unit such as a motor, thereby conveying the liquid-impregnated member. One exemplary sheet-shaped wiping unit with such a configuration is disclosed in Japanese Patent No. 4072087. In Japanese Patent No. 4072087, in order to wipe an ink discharge port face by using an unused portion of a sheet member, the sheet member is conveyed by a certain length.

By the way, in order to wipe off ink residues firmly attached to an ink discharge port face, it is effective to impregnate a liquid-impregnated member (hereinafter may also be referred to as a "wiping member") with a wiping liquid. Roughly speaking, there are two types of methods of impregnating a wiping member with a wiping liquid.

A first method is impregnating a wiping member with a wiping liquid immediately before a wiping operation is performed by a sheet-shaped wiping unit. This method has an advantage that a highly volatile liquid can be used as the wiping liquid. On the contrary, a wiping liquid coating unit such as a wiping liquid spray becomes necessary, resulting in a disadvantage that the size and cost of the apparatus are increased.

A second method is impregnating a wiping member with a wiping liquid in advance. This method has an advantage that the size and cost of the apparatus can be reduced. On the contrary, there is a disadvantage that it is difficult to use a highly volatile liquid as the wiping liquid.

Further in the second method, when a substantially non-volatile liquid is used as the wiping liquid, a problem occurs after a sheet-shaped wiping unit is let to stand for a long time (such as about ten hours) without conveying the wiping member, as described below.

In the second method of impregnating the wiping member with the wiping liquid in advance, as described above, it is difficult to use a highly volatile liquid as the wiping liquid. Thus, it is difficult to use a wiping liquid that has water, which is most appropriate as a wiping liquid, as a main component. Therefore, in many cases, solvents with a low volatility appropriate as wiping liquids are used. However, many solvents appropriate as wiping liquids absorb atmospheric moisture or discharge moisture to atmosphere in accordance with the ambient temperature and humidity. Thus, when the sheet-shaped wiping unit is let to stand for a long time without conveying the wiping member, a rolled portion of the wiping member (hereinafter referred to as a "rolled portion") and a portion that has not been rolled (hereinafter referred to as a "not-rolled portion") may have a difference in moisture content of the wiping liquid. That is, the moisture content of the wiping liquid of the wiping member after the sheet-shaped wiping unit is let to stand for a long time is such that the moisture content in the rolled portion does not change much, whereas the moisture content in the not-rolled portion, which is directly exposed to the atmosphere, may greatly change in accordance with the ambient temperature and humidity. For example, when the ambient humidity is high, the moisture content of the wiping liquid in the not-rolled portion which performs a wiping operation increases. Thus, the wiping performance is not degraded. However, when the ambient humidity is low, the moisture content of the wiping liquid in the not-rolled portion decreases, resulting in degrading of the wiping performance.

In many cases, inkjet recording apparatus of the recent years are configured such that ink is discharged from ink discharge ports toward the direction of gravity (vertical direction). In such a configuration, the not-rolled portion which performs a wiping operation is substantially consequently arranged above the rolled portion in the vertical direction. Thus, when the sheet-shaped wiping unit is let to stand for a long time without conveying the wiping unit, the overall wiping liquid impregnating the wiping member moves downward due to gravity, and, accordingly, a portion of the wiping liquid impregnating the not-rolled portion which performs a wiping operation moves toward the rolled portion. As a result, the impregnating amount of the wiping liquid in the not-rolled portion which performs a wiping operation is reduced, and hence, the wiping performance is degraded.

As described above, when the sheet-shaped wiping unit is let to stand for a long time without performing a wiping operation, one or both of the moisture content of the impregnating wiping liquid, and the impregnating amount of the wiping liquid become different between the rolled portion and the not-rolled portion. Therefore, the wiping performance of the sheet-shaped wiping unit is degraded.

SUMMARY OF THE INVENTION

According to an aspect of the present invention, an inkjet recording apparatus includes a recording head including a discharge port face with a plurality of discharge ports configured to discharge ink, a carriage having the recording head mounted thereon, wherein the carriage is configured to perform reciprocal scanning, a wiping unit including a sheet-shaped wiping member configured to wipe the discharge port face and a conveying unit configured to convey the wiping member, and a controller configured to control an amount of conveyance of the wiping member by the conveying unit, wherein the controller performs control so that the conveyance amount in a first case, where a time elapsed since a last conveyance operation of the wiping member is greater than or equal to a certain time, becomes greater than the conveyance amount in a second case, where the time elapsed since the last conveyance operation of the wiping member is less than the certain time.

The present invention provides an inkjet recording apparatus capable of performing an efficient wiping operation of an ink discharge port face of a recording head without degrading the wiping performance when performing the wiping operation. That is, according to an aspect of the present invention, there is provided an inkjet recording apparatus including: a recording head including a discharge port face with a plurality of discharge ports configured to discharge ink; a carriage that has the recording head mounted thereon and that is configured to perform reciprocal scanning; a wiping unit including a sheet-shaped wiping member configured to wipe the discharge port face and a conveying unit configured to convey the wiping member; and a controller configured to control the amount of conveyance of the wiping member by the conveying unit. The controller performs control so that the conveyance amount in a first case where a time elapsed since a last conveyance operation of the wiping member is greater than or equal to a certain time becomes greater than the conveyance amount in a second case where the time elapsed since the last conveyance operation of the wiping member is less than the certain time.

Accordingly, an inkjet recording apparatus capable of efficiently performing a wiping operation of an ink discharge port face of a recording head without degrading the wiping performance when performing the wiping operation may be provided.

Further features of the present invention will become apparent from the following description of exemplary embodiments with reference to the attached drawings.

DESCRIPTION OF THE EMBODIMENTS

Hereinafter, an embodiment of the present invention will be described with reference to the drawings.

Figure 1:
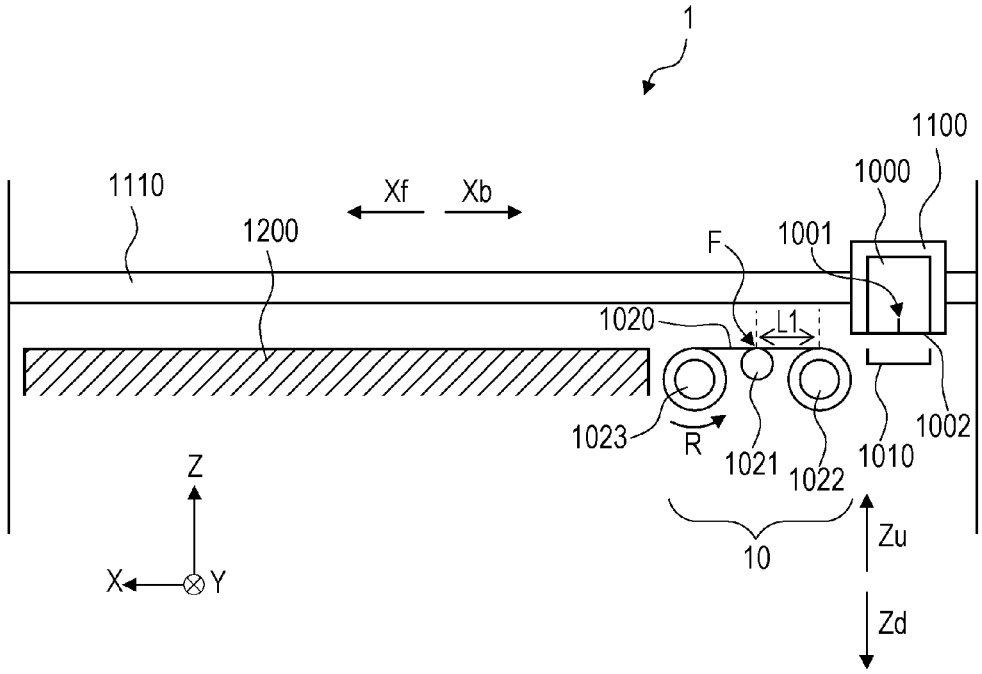
FIG. 1 is a schematic cross section of an inkjet recording apparatus according to an embodiment of the present invention.

FIG. 1 is a main part cross section schematically illustrating an inkjet recording apparatus according to an embodiment of the present invention.

Referring to FIG. 1, an inkjet recording apparatus 1 includes a recording head 1000 that is mounted on a carriage 1100 and that has an ink discharge port face 1002 on which ink discharge ports 1001 are formed. The recording head 1000 is arranged so that ink is discharged from each of the ink discharge ports 1001 toward the vertical direction (hereinafter referred to as the "Z direction"), that is, the ink discharge port face 1002 becomes horizontal. The ink discharge ports 1001 are arranged in the vertical direction (hereinafter referred to as the "Y direction") in FIG. 1, and electro-thermal conversion elements are provided in the individual ink discharge ports 1001. In response to application of an electric signal based on a drive signal to the electro-thermal conversion elements, the recording head 1000 generates air bubbles in ink, and, with the use of the pressure of these air bubbles, ink is discharged from the ink discharge ports 1001. Ink is supplied to the recording head 1000 from ink tanks (not illustrated).

The carriage 1100 is driven by a carriage motor (not illustrated) and is configured to be reciprocally movable in a main scanning direction (hereinafter referred to as an "X direction") along a guide shaft 1110. The reciprocal movement of the carriage 1100 is performed while conveyance of a medium to be recorded (hereinafter may simply be referred to as a "medium"), which is intermittently conveyed in a sub scanning direction (Y direction) on a platen 1200 in accordance with the intermittent rotation of a medium conveyance motor (not illustrated). During this reciprocal movement, recording is performed by the recording head 1000, that is, ink is discharged from the ink discharge ports 1001 of the recording head 1000 toward the medium. In this manner, the intermittent conveyance of the medium and the ink discharge during the reciprocal movement of the carriage 1100 are repeated, thereby completing recording on one sheet of the medium.

Also, the inkjet recording apparatus 1 includes a cap 1010 that is configured to be reciprocally moved in the Z direction by a known unit and that is capable of moving between a capping position and a separated position. FIG. 1 illustrates the cap 1010 positioned at the separated position.

Further, a wiping unit 10 that wipes the ink discharge port face 1002 of the recording head 1000 is provided at one end side of a scan area of the carriage 1100.

Next, the wiping unit 10 will be described in detail. The wiping unit 10 includes a porous body formed to have a thin and long sheet shape. The wiping unit 10 includes a liquid-impregnated member (wiping member) 1020 impregnated in advance with a wiping liquid that has, as a main component, a solvent with low volatility, such as polyethylene glycol. Hereinafter, the liquid-impregnated member (wiping member) 1020 will also be referred to as a sheet member.

One of two ends of the sheet member 1020, formed to have a thin and long sheet shape, is rolled around a first core material 1022, and the other end is rolled around a second core material 1023. A portion of the sheet member 1020 is arranged so that a portion that is not rolled (hereinafter referred to as a "not-rolled portion") faces the ink discharge port face 1002 at the time the recording head 1000 reciprocally moves. That is, the not-rolled portion of the sheet member 1020 is arranged above the first core material 1022 and the second core material 1023 in the vertical direction.

Of the sheet member 1020, the back of the not-rolled portion (face opposite to that facing the ink discharge port face 1002) is supported by a supporting member 1021 of the sheet member 1020, which is made of an elastic material. The supporting member 1021 is configured to be reciprocally moved in the Z direction by a known unit. Accordingly, the supporting member 1021 can move between a wiping position (first position) capable of abutting the ink discharge port face 1002 which the sheet member 1020 faces, and a retracted position (second position) retracted from the ink discharge port face 1002. FIG. 1 illustrates the supporting member 1021 positioned at the retracted position, which is positioned below the wiping position in the vertical direction.

The second core material 1023 is driven by the conveyance motor of the sheet member 1020 and is configured to rotate in the R direction in FIG. 1. Accordingly, the sheet member 1020 can be conveyed in the same direction as the forward direction (see the arrow Xf direction in FIG. 1) of the carriage 1100. In contrast, the first core material 1022 is configured to rotate in association with the rotation of the second core material 1023. The first core material 1022 includes a known torque limiter so as not to rotate when the supporting member 1021 reciprocally moves in the vertical direction. The conveyance length of the sheet member 1020 is controlled by the rotation amount of the conveyance motor. Alternatively, the conveyance length of the sheet member 1020 may be controlled on the basis of, for example, the measurement result of a known unit, such as a conveyance length measuring unit using an optical unit. At this time, a scale (markings) for measuring the length may preferably be added at an end along the conveying direction of the sheet member 1020.

Note that the not-rolled portion of the sheet member 1020 has, as illustrated in FIG. 1, a first length L1 at a portion on the upstream side in the conveying direction, from an abutment portion F with the supporting member 1021. In the present embodiment, the first length L1 is, for example, 50 mm.

Figure 2:
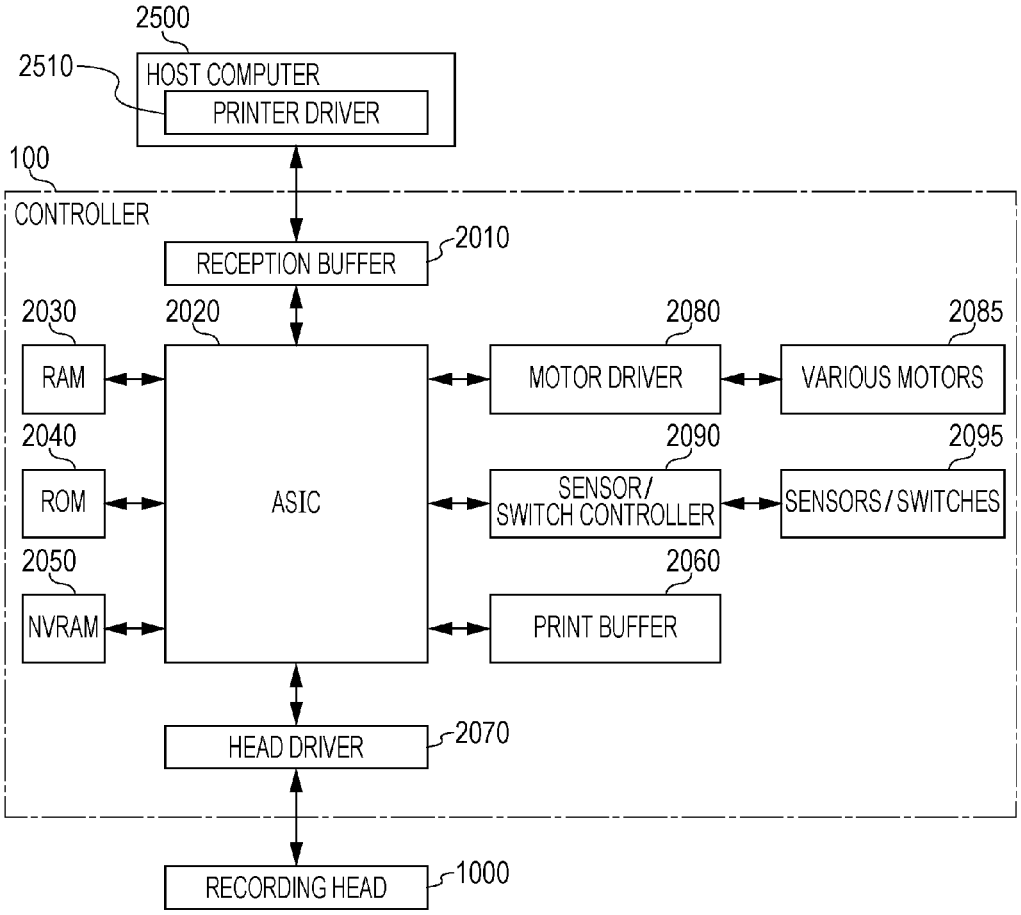
FIG. 2 is a block diagram illustrating the configuration of a control system of the inkjet recording apparatus illustrated in FIG. 1.

Next, referring to FIG. 2, the configuration of a control system of the inkjet recording apparatus 1 according to the present embodiment will be described. FIG. 2 is a block diagram illustrating the configuration of the control system of the inkjet recording apparatus 1 according to the present embodiment.

A controller 100 of the inkjet recording apparatus 1 is connected to a host computer 2500 by, for example, a universal serial bus (USB) interface or the like. In the host computer 2500, a printer driver 2510 is stored in the format of software. In response to a print command given from a user, the printer driver 2510 generates print data from image data such as a document desired by the user, and transmits the print data to the inkjet recording apparatus 1.

The print data transmitted from the host computer 2500 is temporarily held in a reception buffer 2010, and, under management of an application-specific integrated circuit (ASIC) 2020, transferred to a random access memory (RAM) 2030 and temporarily stored in the RAM 2030.

Under management of the ASIC 2020, the print data temporarily stored in the RAM 2030 is converted to recording data by using, for example, a program stored in a read only memory (ROM) 2040 or the like. The ROM 2040 is a non-volatile memory that stores a program necessary for performing various types of control of the inkjet recording apparatus 1, fixed data, and the like. A non-volatile RAM (NVRAM) 2050 is a non-volatile memory for saving information that should be stored even when power of the inkjet recording apparatus 1 is turned off.

The recording data, obtained by conversion, is temporarily stored in a print buffer 2060. The recording data is sent to a head driver 2070 at the time storing of the recording data, corresponding to ink discharged during one main scan of the carriage 1100, into the print buffer 2060 is completed.

Also, a motor driver 2080 drives various motors 2085 including the carriage motor, the medium conveyance motor, and the conveyance motor. A sensor/switch controller 2090 controls various sensors/switches 2095.

Figure 3:
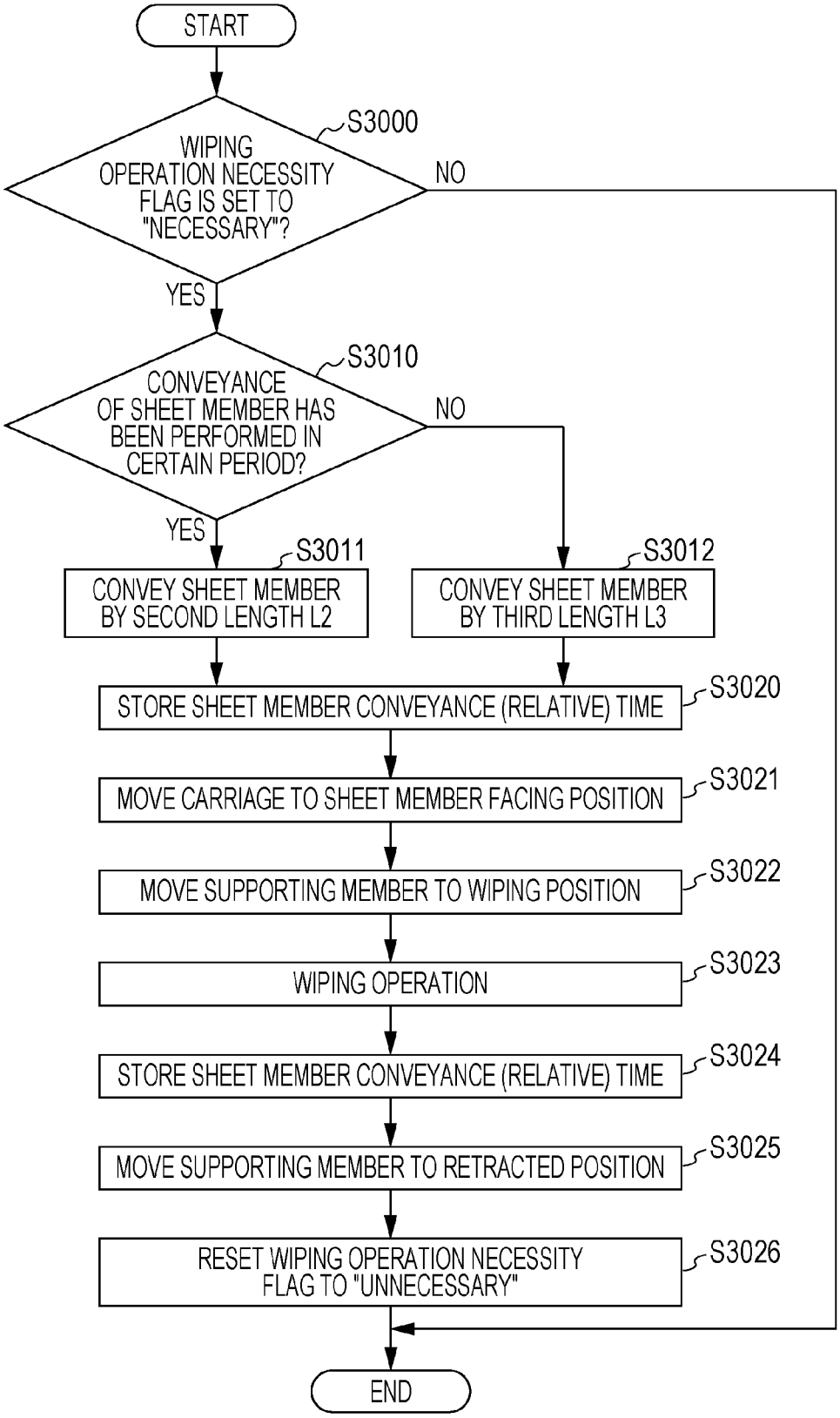
FIG. 3 is a flowchart illustrating an example of a wiping sequence according to the embodiment of the present invention.

Next, a wiping operation performed by the inkjet recording apparatus 1 according to the present embodiment will be described. FIG. 3 is a flowchart illustrating an example of a wiping sequence according to the present embodiment.

When the wiping sequence starts, firstly, reference is made to a wiping operation necessity flag in the NVRAM 2050 to determine whether "necessary" or "unnecessary" is stored (step S3000). Note that the wiping operation necessity flag stores that a wiping operation is "necessary" or "unnecessary" by using a known method, such as that the fact that a wiping operation is "necessary" is stored in the case where the total amount of ink discharge in the immediately previous wiping operation exceeds a threshold.

When "unnecessary" is stored in the wiping operation necessity flag, the wiping sequence ends without performing a wiping operation described later. In contrast, when "necessary" is stored in the wiping operation necessity flag, reference is again made to the interior of the NVRAM 2050 to determine whether conveyance of the sheet member 1020 has been performed within a certain period (step S3010). Note that this certain period is set to, for example, ten hours.

When it is determined in step S3010 that conveyance of the sheet member 1020 has been performed within the certain period, the sheet member 1020 is conveyed by a second length L2 (step S3011). Note that the second length L2 in this case is set to, for example, 5 mm. In response to conveyance of the sheet member 1020 by the second length L2, thereafter, a wiping operation using an unused portion of the sheet member 1020, which has not been used for a previous wiping operation, becomes executable.

When conveyance of the sheet member 1020 is performed, the time at which conveyance is performed (sheet member conveyance execution time) is stored in the NVRAM 2050 (step S3020). Note that this time need not be an absolute time in terms of minute, hour, date, and year, and may be a relative time in the inkjet recording apparatus 1. Thereafter, the carriage 1100 is moved to a position facing the sheet member 1020 (sheet member facing position) (step S3021).

Figure 4:
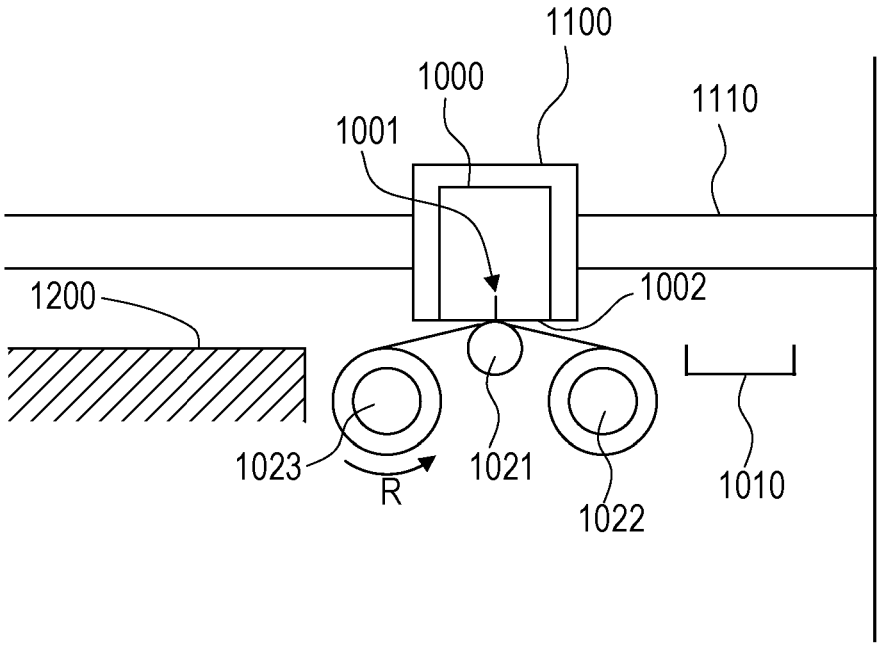
FIG. 4 is an enlarged cross section schematically illustrating the inkjet recording apparatus illustrated in FIG. 1.

When the carriage 1100 moves to the sheet member facing position, the supporting member 1021 made of an elastic member is moved in a direction from the retracted position to the wiping position (see the arrow Zu in FIG. 1), and the sheet member 1020 is caused to contact the ink discharge port face 1002. That is, the supporting member 1021 is moved to the wiping position. Note that, at this time, the first and second core materials 1022 and 1023 do note rotate. Thus, the sheet member 1020 made of a porous body is elastically extended. Also, the abutment portion of the supporting member 1021 with the sheet member 1020 is elastically deformed due to a retraction force from the ink discharge port face 1002. FIG. 4 illustrates the sheet member 1020 in contact with the ink discharge port face 1002.

Thereafter, a wiping operation is executed (step S3023). Specifically, the sheet member 1020 is conveyed while being in contact with the ink discharge port face 1002. With this wiping operation, even when ink residues are firmly attached to the ink discharge port face 1002, the ink residues can be wiped off and removed. Note that the conveyance length of the sheet member 1020 is set to, for example, 50 mm. Also, as has been described above, because the first core material 1022 includes the torque limiter, the sheet member 1020 is conveyed while being elastically extended.

When the wiping operation (sheet member conveyance) ends, as in step S3020, a relative sheet member conveyance execution time is stored in the NVRAM 2050 (step S3024). At this time, the time stored in step S3020 need not be simultaneously stored. That is, it can be controlled to store the relative sheet member conveyance execution time in the same memory region in the NVRAM 2050. Also, the relative sheet member conveyance execution time stored in the NVRAM 2050 need not be stored after the certain period (ten hours in the present embodiment) has elapsed.

Next, the supporting member 1021 is moved to the retracted position in a direction from the wiping position to the retracted position (see the arrow Zd in FIG. 1) (step S3025). In response to this movement, the sheet member 1020, which has been elastically extended, returns to its original length, and the sheet member 1020 becomes separated from the ink discharge port face 1002.

Thereafter, the wiping operation necessity flag is reset to "unnecessary" (step S3026), and the wiping sequence ends. Note that the fact that a wiping operation is "necessary" is stored in the wiping operation necessity flag by using a known method, such as that the fact that a wiping operation is "necessary" is stored in the case where the total amount of ink discharge in the immediately previous wiping operation exceeds a threshold.

In contrast, when it is determined in step S3010 that conveyance of the sheet member 1020 has not been performed within the certain period, the sheet member 1020 is conveyed by a third length L3, instead of conveying the sheet member 1020 by the second length L2 in step S3011 (step S3012). Here, the third length L3 is a distance longer than the first length L1 corresponding to the unused portion of the not-rolled portion, and the third length L3 is set to, for example, 5 mm.

That is, in response to this sheet member conveyance, of the unused portion of the sheet member 1020, a portion that is rolled around the first core material 1022 and that is not exposed to air (hereinafter called a "rolled portion") is conveyed to the position of the supporting member 1021. Thus, the sheet member 1020 that has been a rolled portion until just before is used in a wiping operation performed thereafter. Therefore, even when the sheet member 1020 is let to stand for a long time without being conveyed, a wiping operation using a portion in which one or both of the moisture content of the impregnating wiping liquid, and the impregnating amount of the wiping liquid are not reduced. That is, degrading of the wiping performance is prevented, and, with a wiping operation performed in step S3023 thereafter, even the ink residues firmly attached to the ink discharge port face 1002 can be wiped off and removed.

As described above, according to the wiping sequence of the present embodiment, the sheet member 1020 can be conveyed by an appropriate length, before a wiping operation is performed, in accordance with a conveyance history of the sheet member 1020 up to that time. Accordingly, even when the sheet member 1020 is let to stand for a long time without being conveyed, degrading of the wiping performance in a wiping operation can be prevented. Otherwise, a wiping operation can be efficiently performed by preventing wasting of the sheet member 1020.

Figure 5:
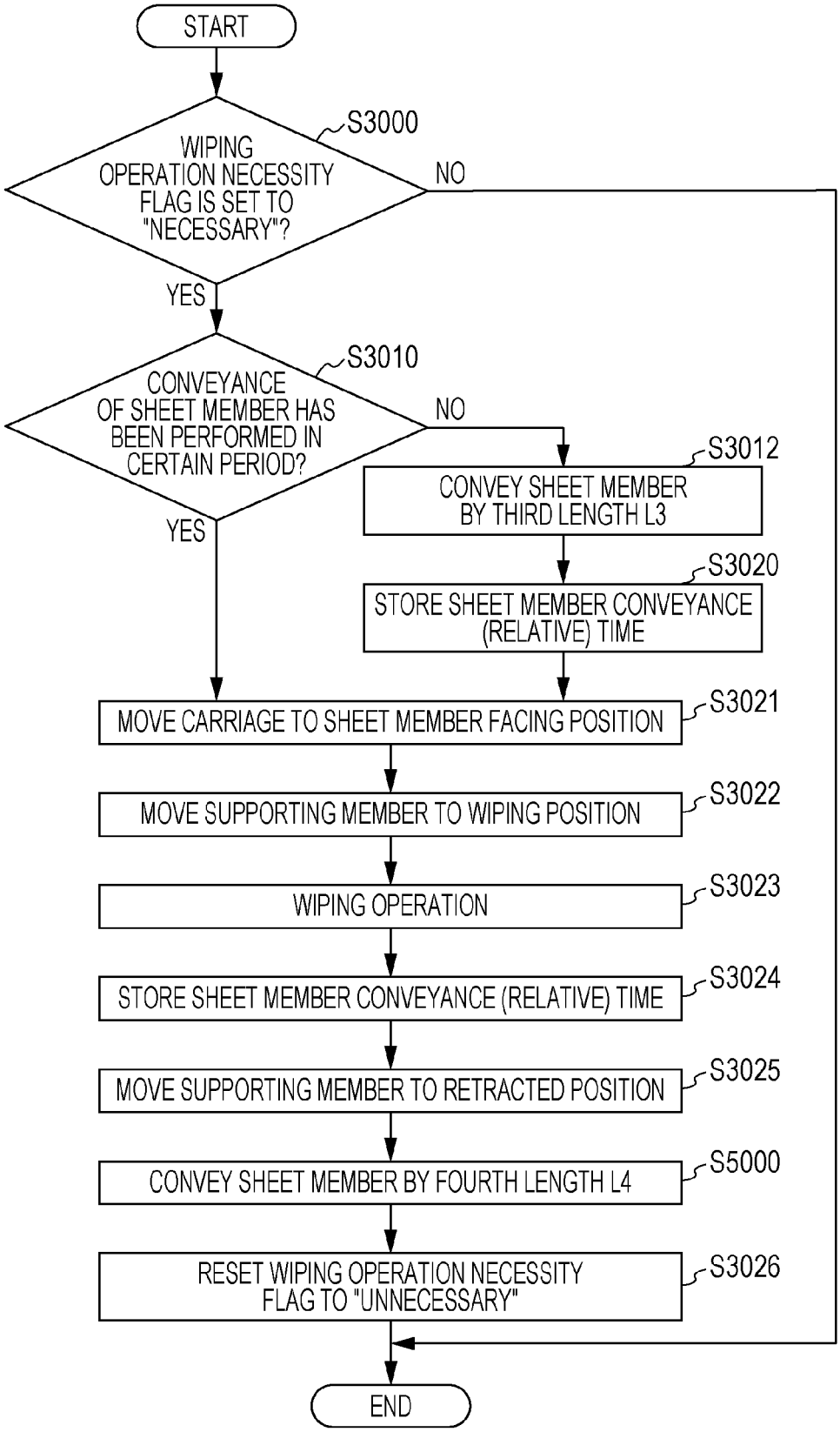
FIG. 5 is a flowchart illustrating another example of the wiping sequence according to the embodiment of the present invention.

FIG. 5 is a flowchart illustrating another example of the wiping sequence in the inkjet recording apparatus 1 according to the embodiment of the present invention. Note that the same step as that in the wiping sequence illustrated in FIG. 3 is given the same reference numeral, and a description thereof is omitted.

In the wiping sequence illustrated in FIG. 5, when it is determined in step S3010 that conveyance of the sheet member 1020 has been performed within the certain period, the sheet member 1020 is not conveyed before the carriage 1100 is moved to the sheet member facing position in step S3021. In accordance with this, the conveyance execution time is not stored. Instead, in step S3025, the supporting member 1021 is moved to the retracted position, and then the sheet member 1020 is conveyed by a fourth length L4 (step S5000).

That is, in response to this sheet member conveyance, even when a material with very low elasticity is adopted as the sheet member 1020, the sheet member 1020 can be surely separated from the ink discharge port face 1002. Further, in response to this sheet member conveyance, when the wiping sequence is executed the next time, a wiping operation using the unused portion of the sheet member 1020 becomes executable without conveying the sheet member 1020 prior to a wiping operation. Note that, when a material with very low elasticity is adopted as the sheet member 1020, a control value of the torque limiter provided at the first core material 1022 is changed to make sure that the first core material 1022 rotates when the supporting member 1021 is moved to the wiping position. Also, the fourth length L4 in this case is set to, for example, 5 mm.

As has been described above, when a material with very low elasticity is adopted as the sheet member 1020, the same or similar advantageous effects as in the case of the wiping sequence illustrated in FIG. 3 can be achieved.

Next, a print operation performed by the inkjet recording apparatus 1 according to the present embodiment will be described.

Figure 6:
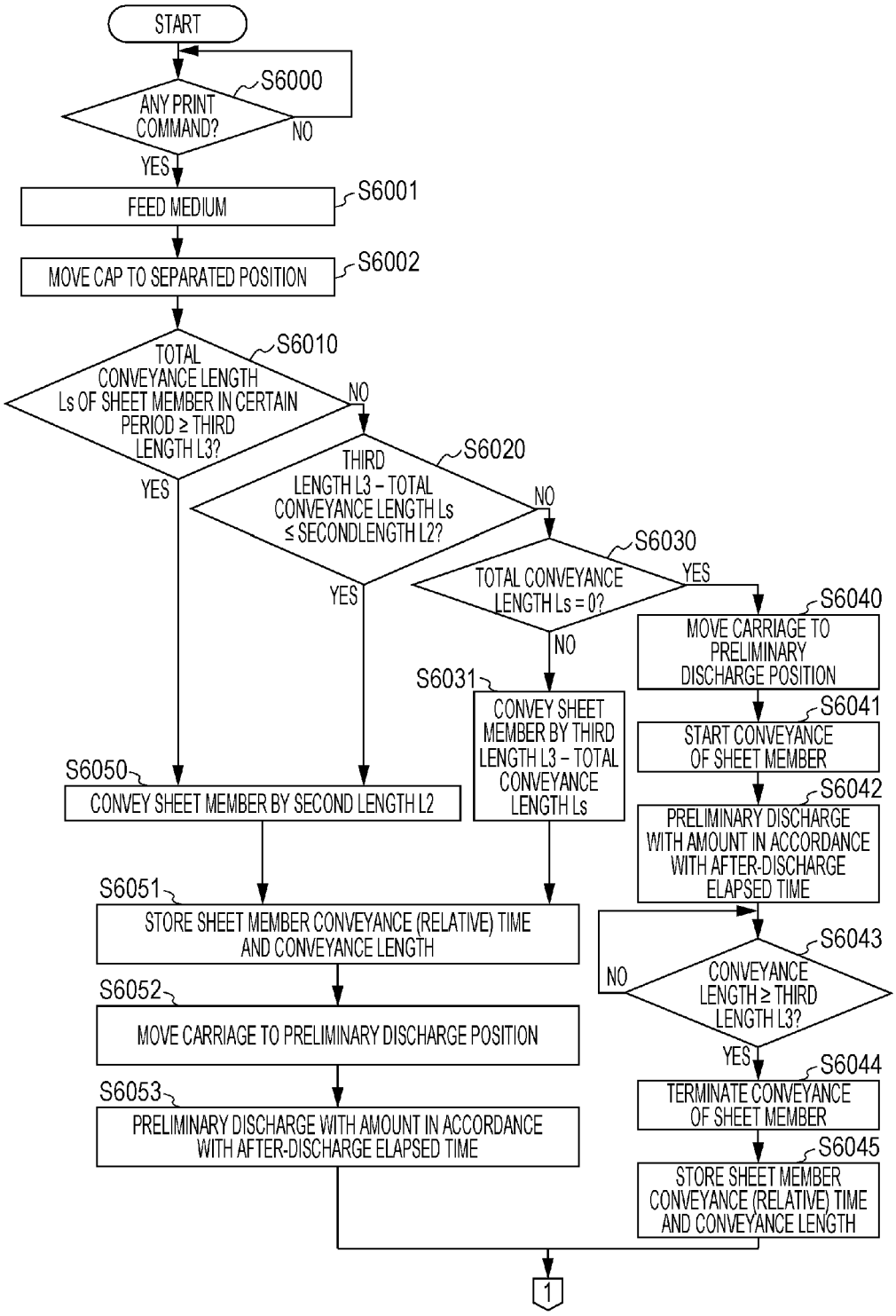
FIG. 6 is a flowchart illustrating a print sequence according to the embodiment of the present invention.
Figure 7:
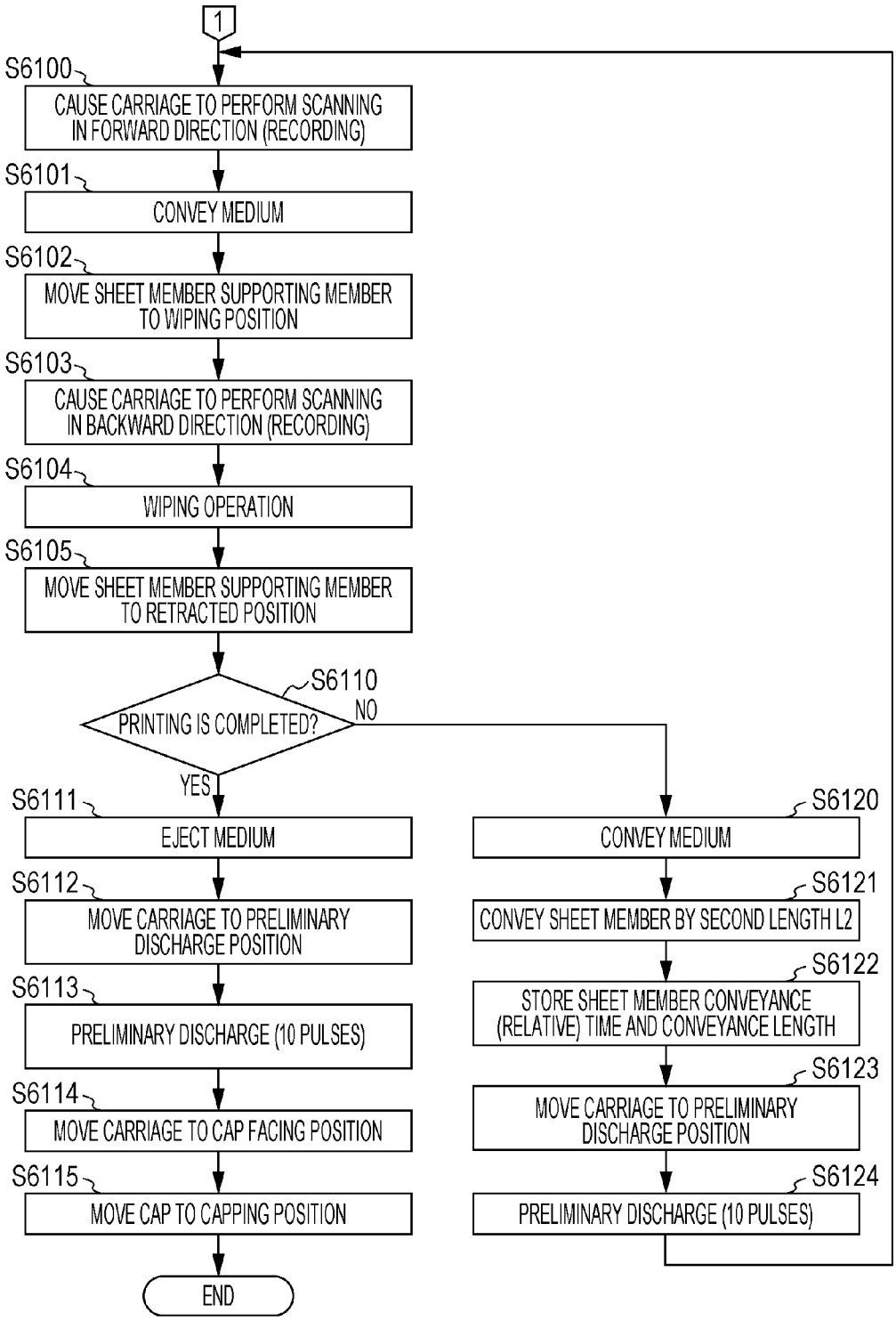
FIG. 7 is a flowchart continued from the flowchart illustrated in FIG. 6.

FIGS. 6 and 7 are flowcharts illustrating a print sequence in the inkjet recording apparatus 1 according to the present embodiment.

Firstly, it is determined whether a print command has been transmitted from the host computer 2500 (step S6000). When it is determined that no print command has been transmitted, step S6000 is repeated until a print command is transmitted. In contrast, when a print command is transmitted from the host computer 2500, a medium is fed to a certain recording start position (step S6001).

Thereafter, the cap 1010 is moved to the separated position in a direction from the capping position to the separated position (see the arrow Zd in FIG. 1) (step S6002).

When the cap 1010 is moved to the separated position, reference is made to the interior of the NVRAM 2050, and it is determined whether a total conveyance length Ls of the length of conveyance of the sheet member 1020 within a certain set period is greater than or equal to the third length L3 (step S6010). Note that the set period in this case is set to, for example, ten hours. The third length L3 is set to a distance longer than the first length L1 corresponding to the unused portion of the not-rolled portion, such as 55 mm.

When it is determined in step S6010 that the total conveyance length Ls of the sheet member 1020 in the set period is greater than or equal to the third length L3 (55 mm in the present embodiment), the sheet member 1020 is conveyed by the second length L2 (step S6050). Note that the second length L2 in this case is set to, for example, 5 mm. In response to this sheet member conveyance, thereafter, as has been described above, a wiping operation using the unused portion of the sheet member 1020 becomes executable.

When conveyance of the sheet member 1020 is performed, the relative execution time and conveyance length at that time are stored in the NVRAM 2050 (step S6051). Note that these parameters need not be stored after the set period (ten hours in the present embodiment) has elapsed.

Thereafter, the carriage 1100 is moved to a preliminary discharge position a little downstream (5 mm in the present embodiment) of the sheet member facing position illustrated in FIG. 4 in the forward direction (see the arrow Xf in FIG. 1) of the carriage 1100 (step S6052). At this preliminary discharge position, so-called preliminary discharge of discharging ink from the ink discharge ports 1001 to the sheet member 1020 is performed. Note that, at this time, the supporting member 1021 is positioned at the retracted position.

When the carriage 1100 is moved to the preliminary discharge position, preliminary discharge with an amount in accordance with a time that has elapsed since the immediately previous ink discharge (hereinafter referred to as an "after-discharge elapsed time") is performed (S6053). The ink discharge amount in this preliminary discharge increases as the after-discharge elapsed time becomes longer, as is generally known. However, the ink discharge amount in this preliminary discharge is, as indicated below, 200 pulses per ink discharge port (hereinafter may also be simply referred to as "200 pulses") at maximum, which is obtained by conversion into the number of pulses of an electric signal applied to the electro-thermal conversion element in each ink discharge port 1001.

In the print sequence according to the present embodiment, conveyance of the sheet member 1020 is performed during the print sequence. As will be described later, the print sequence ends after preliminary discharge is performed after the conveyance of the sheet member 1020. Thus, at this time, when the total conveyance length Ls of the sheet member 1020 in the set period (ten hours in the present embodiment) is greater than or equal to the third length L3 (55 mm in the present embodiment), conveyance of the sheet member 1020 has been performed in that set period, and thus, preliminary discharge has also been executed. That is, at the point in step S6053, the after-discharge elapsed time is ten hours at maximum. In the print sequence according to the present embodiment, when the after-discharge elapsed time is greater than or equal to six hours and is less than twelve hours, preliminary discharge with 200 pulses is performed. Thus, the ink discharge amount in preliminary discharge in step S6053 is 200 pulses at maximum.

Note that ink droplets in this preliminary discharge land on the sheet member 1020 and are absorbed and held by the sheet member 1020. The ink discharge amount of about 200 pulses can be sufficiently absorbed and held by the sheet member 1020.

After the preliminary discharge is performed in step S6053, the carriage 1100 is caused to perform scanning in the forward direction (see the arrow Xf in FIG. 1), and, during that time, ink is discharged from the ink discharge ports 1001 to the medium, thereby performing a recording operation (step S6100). After the completion of the recording operation, the medium is conveyed by a certain amount in the Y direction (step S6101).

Thereafter, the supporting member 1021 is moved to the wiping position in the direction from the retracted position to the wiping position (see the arrow Zu in FIG. 1) (step S6102). Note that, at this time, the first and second core materials 1022 and 1023 do note rotate, as in the wiping sequence illustrated in FIG. 1. Thus, the sheet member 1020 is elastically extended.

Next, the carriage 1100 is caused to perform scanning in the backward direction (see the arrow Xb in FIG. 1), and, also during that time, ink is discharged from the ink discharge ports 1001 to the medium, thereby performing a recording operation (step S6103).

Scanning performed by the carriage 1100 in the backward direction (see the arrow Xb in FIG. 1) is performed until the carriage 1100 passes the sheet member 1020 positioned at the wiping position. That is, here, the wiping operation of the ink discharge port face 1002 is performed (step S6104). Note that, at this time, the sheet member 1020 is not conveyed. Also, since the sheet member 1020 has been conveyed by the second length L2 in step 6050, the unused portion of the sheet member 1020 is used in this wiping operation.

When the wiping operation ends, the supporting member 1021 is moved to the retracted position in the direction from the wiping position to the retracted position (see the arrow Zd in FIG. 1) (step S6105). In response to this movement, the sheet member 1020, which has been elastically extended, returns to its original length, as in the wiping sequence illustrated in FIG. 3, and the sheet member 1020 becomes separated from the ink discharge port face 1002.

Next, it is determined whether printing on the medium has been completed by the recording operation performed in step S6103 (step S6110).

When it is determined in step S6110 that printing has been completed, the medium is ejected (step S6111). The carriage 1100 is moved to the preliminary discharge position (step S6112), and preliminary discharge with 10 pulses is performed (step S6113). Note that ink droplets in this preliminary discharge land on the sheet member 1020 and are absorbed and held by the sheet member 1020.

Thereafter, the carriage 1100 is moved to a position facing the cap 1010 (step S6114). The cap 1010 is moved to the capping position in the direction from the separated position to the capping position (see the arrow Zu in FIG. 1) (step S6115), that is, capping is performed. Accordingly, the print sequence ends.

As described above, the print sequence according to the present embodiment ends after preliminary discharge is performed.

In contrast, when it is determined in step S6110 that printing has not been completed, as in step S6101, the medium is conveyed by the certain amount in the Y direction. Then, as in step S6050, the sheet member 1020 is conveyed by the second length L2, that is, 5 mm. In response to this sheet member conveyance, thereafter, a wiping operation using the unused portion of the sheet member 1020 becomes executable. Note that, in response to this sheet member conveyance, the sheet member 1020, which is though the not-rolled portion but which is without the possibility of being let to stand for the set time (ten hours in the present embodiment) or longer, is used in the next wiping operation.

When conveyance of the sheet member 1020 is performed, as in step S6051, the relative execution time and conveyance length at that time are stored in the NVRAM 2050 (step S6122). Thereafter, the carriage 1100 is moved to the above-described preliminary discharge position downstream (step S6123), and preliminary discharge with 10 pulses is performed (step S6124). Note that ink droplets in this preliminary discharge land on the sheet member 1020 and are absorbed and held by the sheet member 1020.

After the preliminary discharge is performed in step S6124, the carriage 1100 is caused to perform scanning in the forward direction (see the arrow Xf in FIG. 1), and steps from step S6100 onward are executed again. Thus, such an operation is repeated until it is determined in step S6110 that printing has been completed.

In contrast, when it is determined in step S6010 that the total conveyance length Ls of the sheet member 1020 in the set period is less than the third length L3, it is determined whether the length obtained by subtracting the total conveyance length Ls from the third length L3 is less than or equal to the second length L2 (step S6020).

When it is determined in step S6020 that the length obtained by subtracting the total conveyance length Ls from the third length L3 is less than or equal to the second length L2, step S6050 is performed. That is, the sheet member 1020 is conveyed by the second length L2, that is, 5 mm. In response to this sheet member conveyance, thereafter, as described above, a wiping operation using the unused portion of the sheet member 1020 becomes executable.

Further, in response to this sheet member conveyance, the sheet member 1020, which is though the not-rolled portion but which has not been let to stand for the set time, that is, ten hours, or longer, is used in the next wiping operation. That is, a portion of the sheet member 1020 in which one or both of the moisture content of the impregnating wiping liquid, and the impregnating amount of the wiping liquid are not reduced is used. Thus, degrading of the wiping performance is prevented, and, with a wiping operation performed in step S6104 thereafter, even the ink residues firmly attached to the ink discharge port face 1002 can be wiped off and removed.

Even when it is determined in step S6020 that the length obtained by subtracting the total conveyance length Ls from the third length L3 is less than or equal to the second length L2, the ink discharge amount in preliminary discharge performed in step S6053 is 200 pulses at maximum. This is because, even when the length obtained by subtracting the total conveyance length Ls from the third length L3 is less than or equal to the second length L2, conveyance of the sheet member 1020 has been performed in the set period (ten hours in the present embodiment), and thus, preliminary discharge has also been executed. Thus, at this time, the after-discharge elapsed time is ten hours at maximum. The ink discharge amount in preliminary discharge performed in step S6053 is 200 pulses at maximum.

Thereafter, steps from the above-described step S6051 onward are executed.

In contrast, when it is determined in step S6020 that the length obtained by subtracting the total conveyance length Ls from the third length L3 is longer than the second length L2, it is determined whether the total conveyance length Ls is zero (step S6030).

When it is determined in step S6030 that the total conveyance length Ls is not zero, the sheet member 1020 is conveyed by the length obtained by subtracting the total conveyance length Ls from the third length L3 (step S6031). In response to this sheet member conveyance, the sheet member 1020, which is though the not-rolled portion but which has not been let to stand for the set time, that is, ten hours, or longer, is used in the next wiping operation. Thus, degrading of the wiping performance is prevented, and, with a wiping operation performed in step S6014 thereafter, even the ink residues firmly attached to the ink discharge port face 1002 can be wiped off and removed.

Even when it is determined in step S6030 that the total conveyance length Ls is not zero, the ink discharge amount in preliminary discharge performed in step S6053 is 200 pulses at maximum. This is because, even when the total conveyance length Ls is not zero, conveyance of the sheet member 1020 has been performed in that set period, and thus, preliminary discharge has also been executed. Thus, at this time, the after-discharge elapsed time is ten hours at maximum. The ink discharge amount in preliminary discharge performed in step S6053 is 200 pulses at maximum.

Thereafter, steps from the above-described step S6051 onward are executed.

In contrast, when it is determined in step S6030 that the total conveyance length Ls is zero, the carriage 1100 is moved to the preliminary discharge position (step S6040).

When the carriage 1100 is moved to the preliminary discharge position, conveyance of the sheet member 1020 is started (step S6041), and preliminary discharge with an amount in accordance with the after-discharge elapsed time is performed (step S6042). Note that the ink discharge amount in this preliminary discharge is 4000 pulses at maximum, as described below.

At this time, the sheet member conveyance has not been performed in the set period (ten hours in the present embodiment), and thus, no ink discharge has been performed. Thus, it is unable to determine when the immediately previous ink discharge has been performed. In the print sequence according to the present embodiment, when the after-discharge elapsed time is greater than or equal to 168 hours, it is controlled to perform preliminary discharge with 4000 pulses. Thus, the ink discharge amount in preliminary discharge performed in step S6042 is 4000 pulses at maximum. Also, ink droplets in this preliminary discharge land on the sheet member 1020. However, since the sheet member 1020 is being conveyed, the conveying speed is such a speed at which 200 pulses are preliminarily discharged while the sheet member 1020 is conveyed by 5 mm. Thus, the sheet member 1020 can sufficiently absorb and hold the ink droplets in this preliminary discharge. Note that, when preliminary discharge with 4000 pulses is performed on the sheet member 1020 at a halt, ink of the preliminary discharge greatly bleeds, and, in the worst case, spills from the sheet member 1020.

When preliminary discharge is performed in step S6042, next, it is determined whether the conveyance length of the sheet member 1020 from the start of the sheet member conveyance (step S6041) is greater than or equal to the third length L3, that is, 55 mm (step S6043).

When it is determined in step S6043 that the conveyance length of the sheet member 1020 from the start of the sheet member conveyance is less than the third length L3, the sheet member conveyance is continued until the conveyance length becomes equivalent to the third length L3, and step S6043 is repeated. Note that, as is clear from the conveying speed of the sheet member 1020 described above, at this time, the ink discharge amount in preliminary discharge performed in step S6042 when the conveyance length of the sheet member 1020 from the start of the sheet member conveyance is less than 55 mm is less than 2200 pulses.

In contrast, when it is determined in step S6043 that the conveyance length of the sheet member 1020 from the start of the sheet member conveyance is greater than or equal to the third length L3, the sheet member conveyance is terminated (step S6044).

Note that, in the print sequence according to the present embodiment, when the after-discharge elapsed time is greater than or equal to 72 hours and is less than 168 hours, it is controlled to perform preliminary discharge with 2000 pulses. Thus, when the after-discharge elapsed time is less than 168 hours, it is determined in step S6043 that the conveyance length of the sheet member 1020 from the start of the sheet member conveyance is less than the third length L3 (55 mm in the present embodiment). Thus, the conveyance length of the sheet member 1020 at the time step S6044 is completed is 55 mm. In contrast, when the after-discharge elapsed time is greater than or equal to 168 hours, it is determined in step S6043 that the conveyance length of the sheet member 1020 from the start of the sheet member conveyance is greater than or equal to the third length L3, and the conveyance length of the sheet member 1020 at the time step S6044 is completed is 100 mm. In either case, in response to this sheet member conveyance, the sheet member 1020 that has been a rolled portion until just before is used in the next wiping operation. Therefore, degrading of the wiping performance is prevented, and, with a wiping operation performed in step S6104 thereafter, even the ink residues firmly attached to the ink discharge port face 1002 can be wiped off and removed.

When conveyance of the sheet member 1020 is terminated, the relative sheet member conveyance execution time and conveyance length are stored in the NVRAM 2050 (step S6045), and steps from the above-described step S6010 onward are executed.

As described above, even in the print sequence according to the present embodiment, the sheet member 1020 can be conveyed by an appropriate length, before a wiping operation is performed, in accordance with a conveyance history of the sheet member 1020 up to that time. Accordingly, even when the sheet member 1020 is let to stand for a long time without being conveyed, degrading of the wiping performance in a wiping operation can be prevented. Otherwise, a wiping operation can be efficiently performed by preventing wasting of the sheet member 1020.

Further, when the sheet member 1020 is let to stand for a long time without being conveyed, the amount of ink increases necessarily in preliminary discharge performed thereafter. Even in such a case, the sheet member 1020 can be more effectively used by performing preliminary discharge toward the sheet member 1020 while the sheet member 1020 is being conveyed prior to a wiping operation.

Note that, although the case in which the so-called thermal-type recording head with electro-thermal conversion elements in the ink discharge ports is used has been described by way of example in the above-described embodiment, the present embodiment is not limited to this example. For example, the present embodiment is effectively applicable to the case in which a so-called piezo-type recording head with piezoelectric transducers in the ink discharge ports is used.

Further, in the above-described embodiment, the so-called serial-scan-type inkjet recording apparatus in which the carriage performs reciprocal movement in the X direction and the medium is conveyed in the Y direction has been described by way of example. However, the present embodiment is not limited to this example. For example, the present embodiment is effectively applicable to a full-line-type inkjet recording apparatus using a so-called full-line-type recording head longer than the length of the medium in a direction orthogonal to the conveying direction.

In addition, although the inkjet recording apparatus using only one type of ink has been described by way of example in the above-described embodiment, the present embodiment is also effective to an inkjet recording apparatus using multiple types of ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-080097, filed Mar. 30, 2012 and No. 2013-027687 filed Feb. 15, 2013, which are hereby incorporated by reference herein in their entirety.

What is claimed is:

1. An inkjet recording apparatus comprising:

a recording head including a discharge port face with a plurality of discharge ports configured to discharge ink;

a carriage having the recording head mounted thereon, wherein the carriage is configured to perform reciprocal scanning;

a wiping unit including a sheet-shaped wiping member configured to wipe the discharge port face and a conveying unit configured to convey the sheet-shaped wiping member; and a controller configured to control an amount of conveyance of the sheet-shaped wiping member by the conveying unit, wherein the controller performs control so that the conveyance amount in a first case, where an obtained time elapsed since a last conveyance operation of the sheet-shaped wiping member is greater than or equal to a certain time, becomes greater than the conveyance amount in a second case, where the obtained time elapsed since the last conveyance operation of the sheet-shaped wiping member is less than the certain time.

2. The inkjet recording apparatus of claim 1, wherein the sheet-shaped wiping member is held in a rolled shape, and the conveyance amount in the first case is the amount of conveyance of a rolled portion of the sheet-shaped wiping member, unexposed to air, to a wiping position of the recording head.

3. The inkjet recording apparatus of claim 1, wherein the wiping unit further includes a moving unit configured to move the sheet-shaped wiping member between a first position capable of abutting the ink discharge port face and a second position not abutting the discharge port face, wherein, when the wiping unit wipes the discharge port face, the moving unit moves the sheet-shaped wiping member to the first position.

4. The inkjet recording apparatus of claim 1, wherein a wiping operation of the discharge port face of the recording head is performed by the sheet-shaped wiping member while the carriage is performing scanning over the sheet-shaped wiping member.

5. The inkjet recording apparatus of claim 1, wherein the wiping unit is positioned at one end side of a scan area of the carriage.

6. The inkjet recording apparatus of claim 1, wherein the sheet-shaped wiping member is impregnated with liquid.

7. A method for controlling an inkjet recording apparatus, wherein the inkjet recording apparatus includes a recording head including a discharge port face with a plurality of discharge ports configured to discharge ink and a wiping unit including a sheet-shaped wiping member configured to wipe the discharge port face and a conveying unit configured to convey the sheet-shaped wiping member, the method comprising:

obtaining a time elapsed since a last conveyance operation of the sheet-shaped wiping member; and controlling an amount of conveyance of the sheet-shaped wiping member by the conveying unit, wherein controlling includes controlling so that the conveyance amount in a first case, where the obtained time elapsed since the last conveyance operation of the sheet-shaped wiping member is greater than or equal to a certain time, becomes greater than the conveyance amount in a second case, where the obtained time elapsed since the last conveyance operation of the sheet-shaped wiping member is less than the certain time.

8. The method of claim 7, wherein the sheet-shaped wiping member is held in a rolled shape, and the conveyance amount in the first case is the amount of conveyance of a rolled portion of the sheet-shaped wiping member, unexposed to air, to a wiping position of the recording head.

9. The method of claim 7, further comprising wiping the discharge port face of the recording head by using the sheet-shaped wiping member after the sheet-shaped wiping member is conveyed by the conveying unit.

10. The method of claim 9, wherein the wiping unit further includes a moving unit, the method further comprising moving, using the moving unit, the sheet-shaped wiping member between a first position capable of abutting the ink discharge port face and a second position not abutting the discharge port face, wherein, when the wiping unit wipes the discharge port face, the moving unit moves the sheet-shaped wiping memebr to the first position.

11. An inkjet recording apparatus comprising:

a recording head including a discharge port face with a plurality of discharge ports configured to discharge ink;

a wiping unit including a sheet-shaped wiping member configured to perform a wiping operation to wipe the discharge port face and a conveying unit configured to perform a conveying operation to convey the sheet-shaped wiping member;

a measuring unit configured to measure elapsed time since a previous conveying operation; and a controller configured to control the wiping unit, wherein the controller causes the conveying unit to perform the conveying operation before the wiping operation is performed in a case where the elapsed time measured by the measuring unit is equal to or more than a predetermined time.

12. The inkjet recording apparatus according to claim 11, wherein the controller causes the conveying unit to convey the sheet-shaped wiping member so that a roller portion of the sheet-shaped wiping member, unexposed to air, moves to a wiping position where the wiping operation is performed.

13. The inkjet recording apparatus according to claim 11, wherein the wiping unit further including a moving unit configured to move the sheet-shaped wiping member to a first position capable to abutting the discharge port face and a second position not abutting the discharge port face.

14. The inkjet recording apparatus according to claim 11, further comprising a carriage configured to move the recording head mounted thereon.

15. The inkjet recording apparatus according to claim 11, wherein the sheet-shaped wiping member is impregnated with liquid.

* * * * *